US012723818B2

(12) United States Patent
Lee et al.

(10) Patent No.: US 12,723,818 B2
(45) Date of Patent: Sep. 1, 2026

(54) HEAT EXCHANGER AND AIR CONDITIONER INCLUDING THE SAME

(71) Applicant: Samsung Electronics Co., Ltd., Suwon-si (KR)

(72) Inventors: Sunghee Lee, Suwon-si (KR); Jiho Baek, Suwon-si (KR); Hyunwuk Kang, Suwon-si (KR); Duhan Jung, Suwon-si (KR); Jaewoo Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 53 days.

(21) Appl. No.: 18/374,882

(22) Filed: Sep. 29, 2023

(65) Prior Publication Data

US 2024/0159469 A1 May 16, 2024

Related U.S. Application Data

(63) Continuation of application No. PCT/KR2023/013730, filed on Sep. 13, 2023.

(30) Foreign Application Priority Data

Nov. 10, 2022 (KR) ..... 10-2022-0149353

(51) Int. Cl.
*F28D 7/10* (2006.01)

(52) U.S. Cl.
CPC ..... *F28D 7/10* (2013.01); *F28D 7/106* (2013.01)

(58) Field of Classification Search
CPC . F28D 7/10; F28D 7/103; F28D 7/106; F25B 40/00
See application file for complete search history.

(56) References Cited

U.S. PATENT DOCUMENTS 4,523,941 A 6/1985 Abdel-Hehim et al.
4,577,468 A * 3/1986 Nunn, Jr. ..... F25B 5/00 62/200

(Continued)

FOREIGN PATENT DOCUMENTS

AU 710808 B3 9/1999
CN 206959652 U * 2/2018

(Continued)

OTHER PUBLICATIONS

International Search Report dated Dec. 13, 2023 issued in PCT Application No. PCT/KR2023/013730.

(Continued)

*Primary Examiner* — Eric S Ruppert
(74) *Attorney, Agent, or Firm* — STAAS & HALSEY LLP

(57) ABSTRACT

A heat exchanger including an inner tube including a bending portion, a first heat exchange portion extending from the bending portion, and a second heat exchange portion extending from the bending portion; a first outer tube forming a first double-tube structure around the first heat exchange portion; a second outer tube forming a second double-tube structure around the second heat exchange portion; and a first connection tube connecting a first through hole of the first outer tube and a second through hole of the second outer tube so as to connect the first outer tube and the second outer tube, wherein a first refrigerant is flowable through the heat exchange portions and the bending portion, a second refrigerant is flowable through the outer tubes and the first connection tube, and the second refrigerant exchanges heat with the first refrigerant at boundaries between the respective outer tubes and heat exchange portions.

11 Claims, 6 Drawing Sheets

(56) References Cited

U.S. PATENT DOCUMENTS

| | | | |
|---|---|---|---|
| 9,513,061 | B2 | 12/2016 | Choi et al. |
| 2013/0055749 | A1 | 3/2013 | Kim et al. |
| 2016/0003507 | A1 | 1/2016 | Kim et al. |
| 2016/0313036 | A1 | 10/2016 | Lee |
| 2020/0248845 | A1 | 8/2020 | Cho |

FOREIGN PATENT DOCUMENTS

| | | | | | |
|---|---|---|---|---|---|
| EP | 2 282 140 | A1 | | 2/2011 | |
| EP | 2 873 941 | A1 | | 5/2015 | |
| FR | 2558583 | A2 | * | 7/1985 | ..... F28D 1/0233 |
| GB | 804744 | A | * | 11/1958 | ..... F28D 7/103 |
| JP | 60-111891 | | | 6/1985 | |
| JP | 2-53704 | | | 11/1990 | |
| JP | 6-84174 | | | 12/1994 | |
| JP | 2002-213885 | | | 7/2002 | |
| JP | 2004-93037 | A | | 3/2004 | |
| JP | 2005-164210 | | | 6/2005 | |
| JP | 3910842 | B2 | | 4/2007 | |
| JP | 2009-150573 | | | 7/2009 | |
| JP | 2013228113 | A | * | 11/2013 | |
| JP | 2015-218954 | | | 12/2015 | |
| JP | 5927414 | | | 6/2016 | |
| JP | 6032573 | | | 11/2016 | |
| JP | 2020-531789 | | | 11/2020 | |
| KR | 2003-0090444 | | | 11/2003 | |
| KR | 10-0408677 | B1 | | 12/2003 | |
| KR | 10-0593080 | B1 | | 6/2006 | |
| KR | 10-0593083 | B1 | | 6/2006 | |
| KR | 10-2006-0094756 | | | 8/2006 | |
| KR | 10-2008-0009862 | A | | 1/2008 | |
| KR | 10-2009-0130944 | | | 12/2009 | |
| KR | 10-2013-0027287 | | | 3/2013 | |
| KR | 10-1249721 | B1 | | 4/2013 | |
| KR | 10-1606270 | B1 | | 3/2016 | |
| KR | 10-1645132 | B1 | | 8/2016 | |
| KR | 10-1863513 | B1 | | 5/2018 | |

OTHER PUBLICATIONS

European Extended Search Report dated Sep. 24, 2025 for EP Patent Application No. 23888895.2.

* cited by examiner

HEAT EXCHANGER AND AIR CONDITIONER INCLUDING THE SAME

CROSS-REFERENCE TO RELATED APPLICATIONS

This application is a continuation application, under 35 U.S.C. § 111(a), of International Application No. PCT/KR2023/013730, filed on Sep. 13, 2023, which claims priority under 35 U.S.C. § 119 to Korean Patent Application No. 10-2022-0149353, filed on Nov. 10, 2022, in the Korean Intellectual Property Office, the disclosures of which are incorporated by reference herein in their entireties.

TECHNICAL FIELD

The disclosure provides a heat exchanger and an air conditioner including the heat exchanger.

BACKGROUND ART

In general, an air conditioner is an apparatus for adjusting temperature, humidity, etc., to be appropriate for human activities and simultaneously removing dusts, etc., in the air, by using a cooling cycle. The air conditioner includes an evaporator configured to cool surrounding air by evaporating a refrigerant, a compressor configured to compress a gas-state refrigerant output from the evaporator with a high-temperature and high-pressure, a condenser configured to condense the compressed gas-state refrigerant output from the compressor into a liquid state, and an expansion device configured to decompress the high-pressure liquid state refrigerant output from the condenser.

The air conditioner may be classified into a separation-type air conditioner installed while an indoor unit and an outdoor unit of the air conditioner are separate, and an integration-type air conditional installed while an indoor unit and an outdoor unit of the air conditioner are installed together within one cabinet. In this regard, the separation-type air conditioner is composed of an indoor unit installed indoor and configured to suck the indoor air, exchange heat of the indoor air with a refrigerant, and discharge heat-exchanged air back to the inside, and an outdoor unit configured to exchange heat of the refrigerant from the indoor unit with the outdoor air so as to make the refrigerant in a state capable of heat-exchanging with the indoor air and provide the refrigerant to the indoor unit.

The separation-type air conditioner has applied thereto a subcooler corresponding to a heat exchanger to increase subcooling of the refrigerant by dropping a temperature of the refrigerant in a condensed liquid state. In order for a high-temperature refrigerant to exchange heat with a low-temperature refrigerant in the subcooler, an effective total heat period of a certain length has to be ensured. However, the more a length or size of the subcooler increases to ensure a sufficient effective total heat period, the more a special limitation in a design increases, which results in many difficulties in designing the air conditioner including the subcooler.

DESCRIPTION OF EMBODIMENTS

Solution to Problem

According to an embodiment of the disclosure, a heat exchanger includes an inner tube including a bending portion bent with a preset curvature, and having a first end and a second end, a first heat exchange portion extending from the first end of the bending portion, and a second heat exchange portion extending from the second end of the bending portion; a first outer tube through which the first heat exchange portion extends so as to form a first double-tube structure with a first boundary at an outer circumferential surface of the first heat exchange portion, the first outer tube including a first through hole at an outer circumferential surface of the first outer tube; a second outer tube through which the second heat exchange portion extends so as to form a second double-tube structure with a second boundary at an outer circumferential surface of the second heat exchange portion, the second outer tube including a second through hole at an outer circumferential surface of the second outer tube; and a first connection tube connecting the first through hole of the first outer tube and the second through hole of the second outer tube so as to connect the first outer tube and the second outer tube. The heat exchanger is configured so that a first refrigerant is flowable through the first heat exchange portion, then the bending portion, and then the second heat exchange portion, a second refrigerant is flowable through the first outer tube, then through the first connection tube, and then second outer tube, and the second refrigerant exchanges heat with the first refrigerant at the first boundary inside the first outer tube, and at the second boundary inside the second outer tube.

According to an embodiment of the disclosure, an air conditioner includes a compressor; an indoor heat exchanger; an outdoor heat exchanger; a subcooler; and an expansion valve. At least one of the indoor heat exchanger, the outdoor heat exchanger, and the subcooler includes an inner tube including a bending portion bent with a preset curvature, and having a first end and a second end, a first heat exchange portion extending from the first end of the bending portion, and a second heat exchange portion extending from the second end of the bending portion; a first outer tube through which the first heat exchange portion extends so as to form a first double-tube structure with a first boundary at an outer circumferential surface of the first heat exchange portion, the first outer tube including a first through hole at an outer circumferential surface of the first outer tube; a second outer tube through which the second heat exchange portion extends so as to form a second double-tube structure with a second boundary at an outer circumferential surface of the second heat exchange portion, the second outer tube including a second through hole at an outer circumferential surface of the second outer tube; and a first connection tube connecting the first through hole of the first outer tube and the second through hole of the second outer tube so as to connect the first outer tube and the second outer tube. The at least one of the indoor heat exchanger, the outdoor heat exchanger, and the subcooler is configured so that a first refrigerant is flowable through the first heat exchange portion, then the bending portion, and then the second heat exchange portion, a second refrigerant is flowable through the first outer tube, then through the first connection tube, and then second outer tube, and the second refrigerant exchanges heat with the first refrigerant at the first boundary inside the first outer tube, and at the second boundary inside the second outer tube.

MODE OF DISCLOSURE

Figure 1:
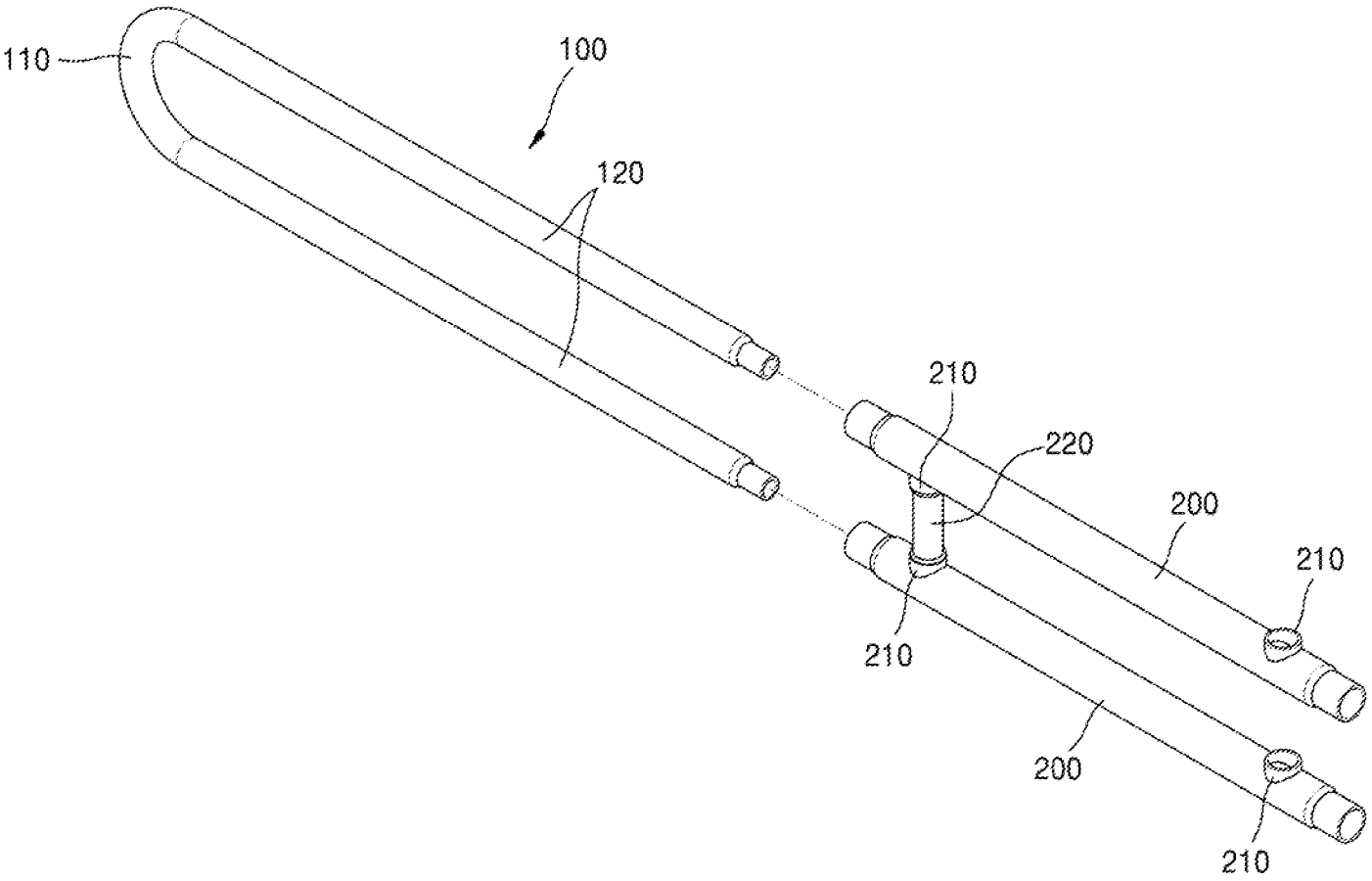
FIG. 1 is an exploded perspective view of a heat exchanger according to an embodiment of the disclosure.

Throughout the disclosure, the expression "at least one of a, b, or c" indicates only a, only b, only c, both a and b, both a and c, both b and c, all of a, b, and c, or variations thereof.

Hereinafter, embodiments of the disclosure will be described in detail with reference to the accompanying drawings. In the drawings, like reference numerals or signs denote parts or elements which perform substantially same functions.

It will be understood that, although the terms "first", "second", etc., may be used herein to describe various elements, these elements should not be limited by these terms. These terms are only used to distinguish one element from another element. For example, a first element discussed below could be termed a second element and, similarly, a second element could be termed a first element without departing from the scope of the disclosure. As used herein, the term "and/or" includes any and all combinations of one or more of the associated listed items.

The terms used in the present specification are merely used to describe embodiments of the disclosure, and are not intended to limit and/or restrict the disclosure. An expression used in the singular encompasses the expression of the plural, unless it has a clearly different meaning in the context. In the present specification, it is to be understood that the terms such as "including", "comprising" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added. In the drawings, like reference numerals denote elements which perform substantially same functions.

Figure 2:
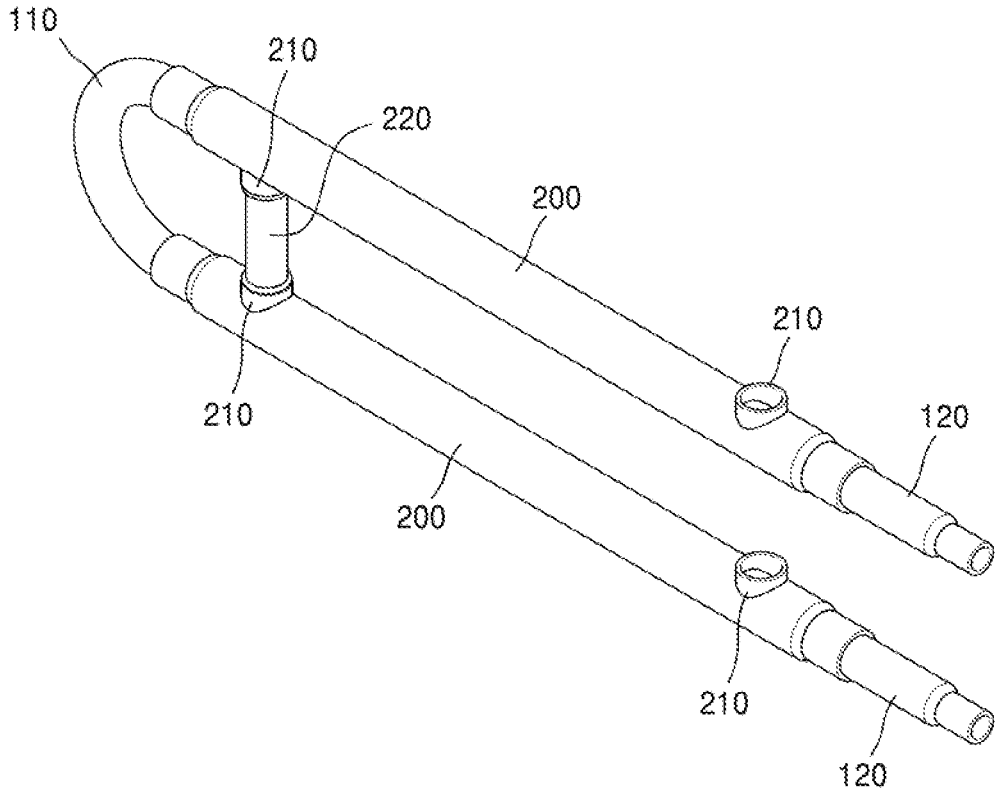
FIG. 2 is a perspective view of the heat exchanger according to an embodiment of the disclosure.

FIG. 1 is an exploded perspective view of a heat exchanger according to an embodiment of the disclosure. FIG. 2 is a perspective view of the heat exchanger according to an embodiment of the disclosure.

Referring to FIGS. 1 and 2, the heat exchanger according to an embodiment of the disclosure may include an inner tube 100 and an outer tube 200. In the heat exchanger according to an embodiment of the disclosure, the inner tube 100 may be provided as a tube forming a single continuous flow path, and the outer tube 200 may be provided as a plurality of independent tubes which are indirectly connected with each other via a connection tube 220.

Such a structure may improve restrictions on the arrangement of the inner tube 100 and outer tube 200, thereby increasing the degree of freedom and design efficiency of the heat exchanger design. Also, a degree of intensity of an effective total heat period where exchange of heat between the inner tube 100 and the outer tube 200 is substantially achieved may be increased. Also, selective replacement is available such that there are merits in maintenance and repair. Detailed effects will be described in each section.

In the heat exchanger according to an embodiment of the disclosure, a first refrigerant may flow in the inner tube 100. For example, in the heat exchanger according to an embodiment of the disclosure, a first refrigerant is flowable through the first heat exchange portion 120-1, then the bending portion 110, and then the second heat exchange portion 120-2 to be described below.

In the heat exchanger according to an embodiment of the disclosure, the first refrigerant may have a temperature different from that of a second refrigerant to be described below, and may increase or decrease a temperature of the second refrigerant by exchanging heat with the second refrigerant. For example, the heat exchanger according to an embodiment of the disclosure may be a subcooler in which exchange of heat is performed in a manner that the first refrigerant is provided as a low-temperature refrigerant, and the second refrigerant is provided as a refrigerant with a higher temperature than the first refrigerant, so that the first refrigerant increases supercooling of the second refrigerant by cooling the second refrigerant.

In an embodiment of the disclosure, the inner tube 100 may include a bending portion 110 that is a portion of the inner tube 100 which is bent with a preset curvature at at least one point, and heat exchange portions 120 that respectively extend from both ends of the bending portion 110. For example, in an embodiment of the disclosure, the bending portion 110 bent with a preset curvature may include a first end and a second end, and may extend the first heat exchange portion 120-1 from the first end of the bending portion 110 and the second heat exchange portion 120-2 from the second end of the bending portion 110.

In an embodiment of the disclosure, the bending portion 110 may be understood as a portion of an inner tube 100 that is bent or deformed so as to allow an inner tube 100 forming a continuous flow path to be inserted into a plurality of outer tubes 200 that are not positioned in a straight line.

For example, the bending portion 110 of the inner tube 100 may be bent in the form of a semicircle to be inserted into the first outer tube 200-1 and the second outer tube 200-2 that are provided in parallel, wherein a remote distance between the first outer tube 200-1 and the second outer tube 200-2 corresponds to a diameter of the semicircle. By doing so, a flow speed of the first refrigerant flowing in the inner tube 100 is not affected, and at the same time, a period in which exchange of heat is not achieved in the inner tube 100 may be minimized.

Alternatively, for example, when the first outer tube 200-1 and the second outer tube 200-2 are positioned on different planes, the bending portion 110 of the inner tube 100 may have deformation.

However, the disclosure is not limited thereto, and the bending portion 110 may be provided including various deformations with various curvatures and various angles so as to allow the heat exchange portions 120 that respectively extend from both ends of the bending portion 110 to be inserted into the outer tubes 200.

In an embodiment of the disclosure, the bending portion 110 may be bent such that a curvature radius thereof is between 10 mm and 30 mm. For example, when the first heat exchange portion 120-1 and the second heat exchange portion 120-2 are provided in parallel, the bending portion 110 may connect a gap between one end part of the first heat exchange portion 120-1 and one end part of the second heat exchange portion 120-2 positioned in parallel, in the form of a semicircle having a radius between 10 mm and 30 mm.

Such small bending radius may be an achievable number as the outer tubes 200 are separate and the outer tubes 200 does not surround the bending portion 110 such that, in bending, the outer tubes 200 do not damage the inner tube 100 by pressing the inner tube 100, and the outer tubes 200 may be connected with a very high degree of freedom.

In an embodiment of the disclosure, the bending portion 110 may include a flexible material, and may have an insulation member (not shown) for surrounding the bending portion 110. Because the bending portion 110 of the inner tube 100 is exposed to the outside, undesired heat exchange may occur by contacting the atmosphere, the bending portion 110 is surrounded by an insulation member to maintain a constant temperature of the first refrigerant flowing through the bending portion 110. However, the disclosure is not limited thereto, and it is obvious that the bending portion 110 may be used without having the insulation member in an environment where it is advantageous for the bending portion 110 to be exposed to the air.

In an example, the insulation member may include a flexible material that is not damaged under bending and does not compress the inner tube 100 therein. For example, the insulation member may include an organic insulator such as expanded-polystyrene, expanded-polyurethane, expanded-vinyl chloride, etc.

In an embodiment of the disclosure, the heat exchange portions 120 of the inner tube 100 may be understood as portions that practically perform exchange of heat with the outer tube 200 at, as a boundary, an outer circumferential surface of the inner tube 100.

In an embodiment of the disclosure, the heat exchange portions 120 may be provided while extending from both ends of the bending portion 110. For example, the heat exchange portions 120 may include the first heat exchange portion 120-1 that is formed with the inner tube 100 extending form the first end of the bending portion 110 and performs heat exchange with the first outer tube 200-1, and the second heat exchange portion 120-2 that is formed with the inner tube 100 extending from the second end of the bending portion 110 and performs heat exchange with the second outer tube 200-2.

Alternatively, in an embodiment of disclosure, the heat exchange portion 120 may be understood as the inner tube 100 that connects between an end of one of the bending portions 110 and an end of another of the bending portions 110, where the bending portions 110 are plural, and performs heat exchange with the outer tube 200.

In an embodiment of the disclosure, the inner tube 100 may be connected to the outer tubes 200 in a manner that the inner tube 100 are inserted into the outer tubes 200, and welding is performed at both ends of the outer tubes 200 between the inner tube 100 and the outer tubes 200. However, the disclosure is not limited thereto.

In an embodiment of the disclosure, when the inner tube 100 is connected to the outer tubes 200, a sealing member or a pressing member may be included to strengthen sealing between the inner tube 100 and the outer tubes 200.

For example, a sealing member may be included between both ends of the first heat exchange portion 120-1 and both ends of the first outer tube 200-1 in which welding is performed, thereby preventing leakage of the second refrigerant.

Other example, after both ends of the first heat exchange portion 120-1 and both ends of the first outer tube 200-1 are connected by welding or the like, a pressing ring may be added to surround both ends of the first outer tube 200-1.

In an embodiment of the disclosure, the inner tube 100 may have a diameter between 6 mm and 10 mm. As the inner tube 100 may be provided to have such a small diameter, an effective total heat length and an effective total heat surface area value in a same space may be increased, and as a result, it is apparent to expect an excellent heat exchange efficiency.

In the heat exchanger according to an embodiment of the disclosure, the outer tubes 200 may be respectively provided at the heat exchange portions 120 of the inner tube 100. For example, in the inner tube 100 forming a single continuous flow path, the outer tubes 200 may be independently provided in such a manner that the outer tubes 200 are not positioned on the bending portion 110 and are positioned only on the heat exchange portions 120 that extend from both ends of the bending portion 110. Accordingly, a degree of freedom in arrangement of the outer tubes 200 is improved, such that a design intensity and efficiency with respect to the heat exchanger may be improved.

In an embodiment of the disclosure, the outer tubes 200 may include therein the heat exchange portions 120 of the inner tube 100, such that a double-tube structure between the inner tube 100 and the outer tubes 200 may be formed. Due to the double-tube structure, a second refrigerant may flow between the outer tube 200 and the heat exchange portion 120 of the inner tube 100, and may exchange heat with a first refrigerant at an outer circumferential surface of the heat exchange portion 120 as a boundary.

For example, the first outer tube 200-1 may include the first heat exchange portion 120-1 of the inner tube 100 inside to form a double-tube structure with the inner tube 100, and the first refrigerant flowing inside the first heat exchange portion 120-1 of the inner tube 100 and the second refrigerant flowing inside the first outer tube 200-1 may exchange heat with the outer circumferential surface of the first heat exchange portion 120-1 as the first boundary.

Equally, the second outer tube 200-2 may include the second heat exchange portion 120-2 of the inner tube 100 inside to form a double-tube structure with the inner tube 100, and the first refrigerant flowing inside the second heat exchange portion 120-2 of the inner tube 100 and the second refrigerant flowing inside the second outer tube 200-2 may exchange heat with the outer circumferential surface of the second heat exchange portion 120-2 as the second boundary.

In an embodiment of the disclosure, the second refrigerant and the first refrigerant may be provided with different temperatures, and a temperature of the first refrigerant may be increased or decreased by exchange of heat.

In an embodiment of the disclosure, the outer tube 200 that is directly connected to other outer tube 200 via the connection tube 220 and the other outer tube 200 may be provided on a same plane.

For example, referring to FIG. 2, the first outer tube 200-1 and the second outer tube 200-2 connected by the first connection tube 220-1 may be provided on a same plane.

However, the disclosure is not limited thereto, and as described above, the bending portion 110 of the inner tube 100 may be bent with deformation, and two outer tubes 200 that are directly connected to each other via the connection tube 220 may be provided on different planes.

In an embodiment of the disclosure, the outer tubes 200 that are connected to each other via the connection tube 220 may be spaced apart from each other by 20 mm to 60 mm.

For example, the first outer tube 200-1 and the second outer tube 200-2 connected to each other via the first connection tube 220-1 may be spaced apart by 20 mm to 60 mm, and the second outer tube 200-2 and the third outer tube 200-3 connected to each other via the second connection tube 220-2 may be spaced apart by 20 mm to 60 mm.

In the heat exchanger, in order to increase the effective heat transfer section, it is necessary to increase the proportion of the heat exchange portion 120 in the heat exchanger by narrowing the gap between the outer tubes 200.

In this case, if the outer tube 200 is also formed at the bending portion 110 of the inner tube 100, the limit of the bending is determined by the outer tube 200, so there is a limit to increasing the proportion of the heat exchange portion 120 compared to the case where there is no outer tube 200 at the bending portion 110 of the inner tube 100, and In another case, the bent outer tubes 200 may press the bending portion 110 of the inner tube 100, such that the inner tube 100 may be damaged.

Also, in general, as the outer tube 200 includes a metal material with a small flexibility and a high rigidity so as to maintain the appearance, there is a limit in bending of the outer tube 200, and when it is bent, a possibility that the outer tube 200 is damaged is increased.

On the other hand, the heat exchanger according to an embodiment of the disclosure, in which each outer tube 200 is provided independently and does not surround the bending portion 110, only bending of the inner tube 100 needs to be considered, a possibility of damage may be decreased, and a gap between the outer tubes 200 that are directly connected to each other via the connection tube 220 may be designed to be very narrow. For example, unlike a conventional heat exchanger where even a bending portion 110 of an inner tube 100 is provided at an outer tube 200, for the heat exchanger according to an embodiment of the disclosure, it is possible to design and manufacture a gap between the first outer tube 200-1 and the second outer tube 200-2 to be equal to or smaller than 60 mm.

Also, in an embodiment of the disclosure, the outer tube 200 may be provided to have a diameter between 12 mm to 20 mm.

For example, each of the first outer tube 200-1, the second outer tube 200-2, and the third outer tube 200-3 may have a diameter of 12 mm to 20 mm.

As described above, because the inner tube 100 may be provided to have such a small diameter, an effective total heat length and an effective total heat surface area value in a same space may be increased, and as a result, it is apparent to expect an excellent heat exchange efficiency.

In the heat exchanger according to an embodiment of the disclosure, a through hole 210 may be understood as a path through which the second refrigerant flows into or is discharged from the outer tube 200.

In an embodiment of the disclosure, the through hole 210 may be provided in each of outer circumferential surfaces of both ends of one outer tube 200. Sizes of the through holes 210 provided at one outer tube 200 may be equal to or different from each other, and an angle between the through holes 210 which is formed with respect to an axis of one outer tube 200 may vary according to designs.

Figure 3:
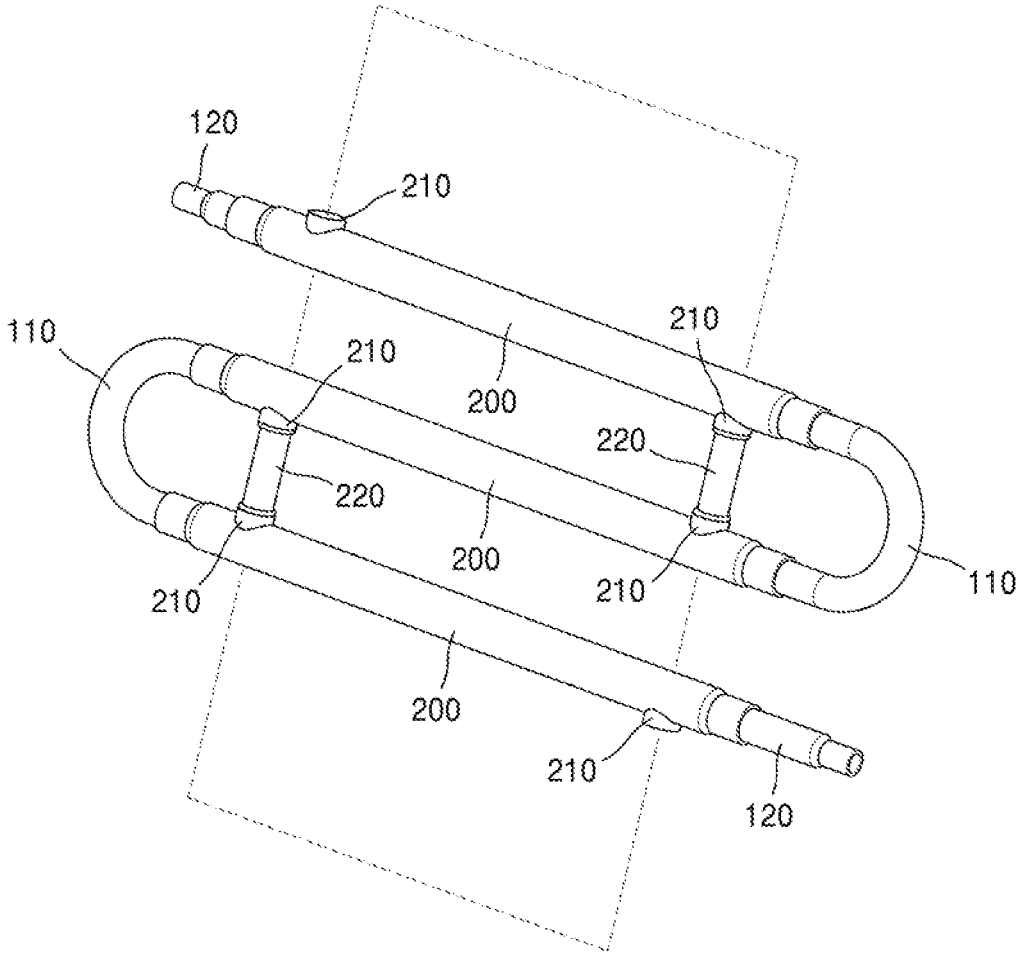
FIG. 3 is a perspective view of a heat exchanger with a three-stage separation structure with which all outer tubes are positioned on a same plane, according to an embodiment of the disclosure.

For example, referring to FIG. 3, the second through hole 210-2 and the third through hole 210-3 on the second tube 200-2 may form a 180 degree angle with respect to an axis of the second outer tube 200-2.

Figure 4:
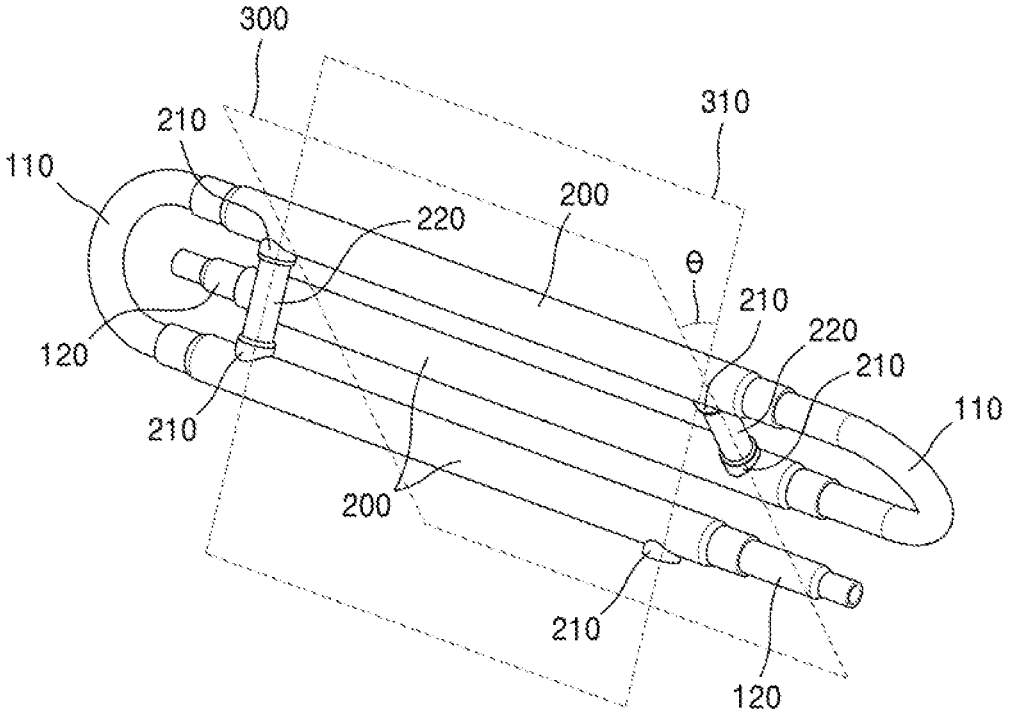
FIG. 4 is a perspective view of a heat exchanger with a three-stage separation structure with which outer tubes are positioned on different planes, according to an embodiment of the disclosure.

For example, referring to FIG. 4, the second through hole 210-2 and the third through hole 210-3 of the second outer tube 200-2 may form an angle less than 180 degrees with respect to an axis of the second outer tube 200-2.

In an embodiment of the disclosure, the through hole 210 may include a connection portion (not shown) to connect the connection tube 220 with the outer tube 200 to be described below. For example, the through hole 210 may be provided in the form of an introduction tube that is projected from an outer circumferential surface of the outer tube 200 and to which the connection tube 220 can be inserted. Alternatively, a female screw thread or a male screw thread which is provided at a side of the through hole 210 is connected with a male screw thread or a female screw thread which is provided at the connection tube 220.

In the heat exchanger according to an embodiment of the disclosure, the connection tube 220 may be understood as a tube that connects the outer tubes 200 positioned at both ends of the bending portion 110 so as to allow a second refrigerant to flow between the outer tubes 200.

According to an embodiment of the disclosure, the connection tube 220 may be provided to have a cylindrical form to connect the outer tubes 200 by a shortest distance. However, the disclosure is not limited thereto, and the connection tube 220 may have a curved surface or a curvature or may be bent with a particular angle, according to designs.

In an embodiment of the disclosure, a cross-sectional area of the connection tube 220 may be equal to an area between the heat exchange portion 120 and the outer tube 200. This is to allow a flow speed of a second refrigerant flowing in the outer tube 200 not to change in the connection tube 220. However, the disclosure is not limited thereto.

In an embodiment of the disclosure, the connection tube 220 may include a material having a preset rigidity. When a gap between the outer tubes 200 is not maintained, a pressure may be applied to the bending portion 110 of the inner tube 100, such that the gap between the outer tubes 200 is maintained by providing the connection tube 220 including the material having the preset rigidity. In designing the heat exchanger, the preset rigidity may be understood as a rigidity enough to maintain the gap between the outer tubes 200.

Figure 5:
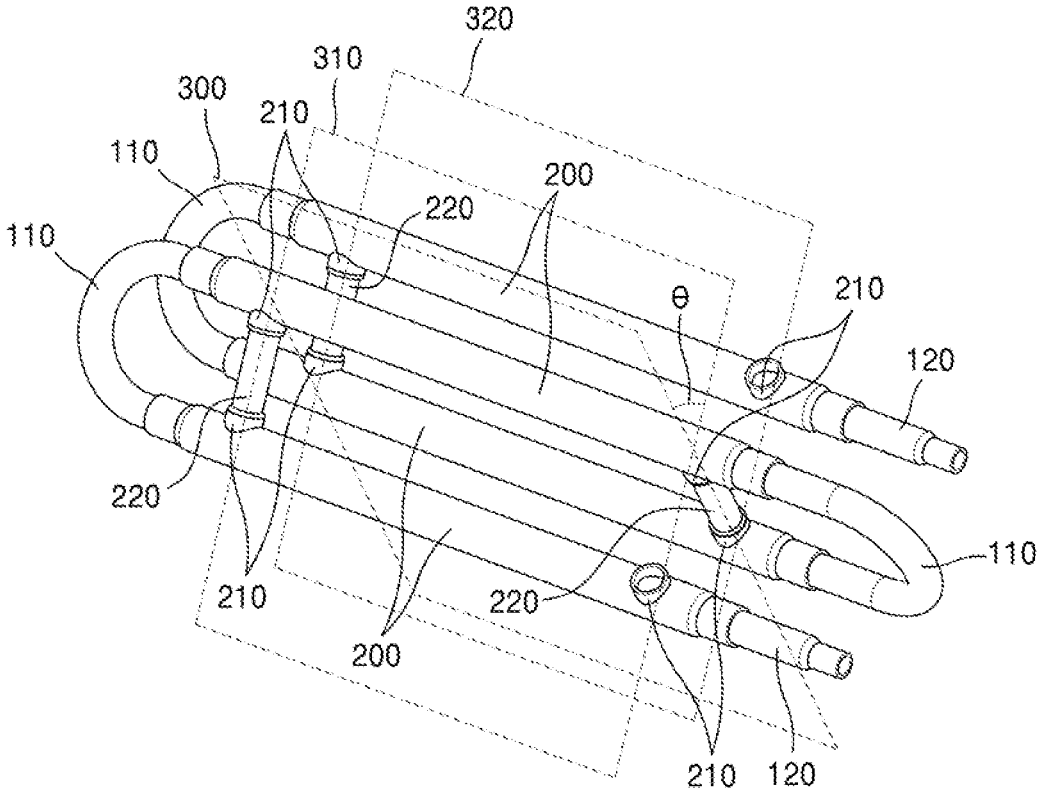
FIG. 5 is a perspective view of a heat exchanger with a four-stage separation structure with which outer tubes are positioned on different planes, according to an embodiment of the disclosure.

FIG. 3 is a perspective view of a heat exchanger with a three-stage separation structure with which all outer tubes 200 are positioned on a same plane, according to an embodiment of the disclosure. FIG. 4 is a perspective view of a heat exchanger with a three-stage separation structure with which the outer tubes 200 are positioned on different planes, according to an embodiment of the disclosure. FIG. 5 is a perspective view of a heat exchanger with a four-stage separation structure with which the outer tubes 200 are positioned on different planes, according to an embodiment of the disclosure.

Referring to FIGS. 3 to 5, in the heat exchanger according to an embodiment of the disclosure, n bending portions 110 may be provided at the inner tube 100, and n+1 outer tubes 200 may be provided. Here, n is a natural number equal to or greater than 2. For example, two bending portions 110 may be provided at inner tube 100 forming a continuous flow path, and three outer tubes 200 may be provided.

Referring to FIG. 3, in the heat exchanger according to an embodiment of the disclosure, all outer tubes 200 may be arranged to be positioned on a same plane. For example, referring to FIG. 3, the first outer tube 200-1, the second outer tube 200-2, and the third outer tube 200-3 may all be positioned on a same plane.

Accordingly, it is apparent that space efficiency is improved, compared to a heat exchanger arranged to have a single axis without the bending portion 110 and have a same effective total heat length.

For example, compared with respect to only an effective heat transfer length, a length to be considered in designing the heat exchanger when the inner tube 100 is designed as a straight line without the bending portion 110 is three times a length of the outer tube 200 shown in FIG. 3.

However, in a case of the heat exchanger according to an embodiment of the disclosure, a length of only one outer tube 200 is requested, and a distance between the outer tubes 200 in parallel may be ignored, in consideration of the length of the outer tube 200. As it is necessary to have a preset effective total heat period to achieve exchange of heat between refrigerants, it is apparent that space efficiency is improved when designing the heat exchanger according to an embodiment of the disclosure.

Referring to FIG. 4, in the heat exchanger according to an embodiment of the disclosure, a first plane 300-1 on which one of the outer tubes 200 and another one of the outer tubes 200 that is directly connected to one side of the one outer tube 200 via the connection tube 220 are positioned may be arranged not to be parallel to a second plane 300-2 on which the one outer tube 200 and the different one outer tube 200 that is directly connected to the other side of the one outer tube 200 via the connection tube 220 are positioned.

For example, a first plane 300-1 on which the second outer tube 200-2 and the first outer tube 200-1 that is directly connected to the second outer tube 200-2 via the first connection tube 220-1 are positioned may not be parallel to the second plane 300-2 on which the second outer tube 200-2 and the third outer tube 200-3 that is directly connected to the second outer tube 200-2 via the second connection tube 220-2 are positioned.

Based on a three-stage separation structure in which the heat exchanger includes two bending portions 110 in the inner tube 100 and three outer tubes 200, it is apparent that the same effective heat transfer length may be implemented within a more compact space when the first plane 300-1 and the second plane 300-2 are not parallel.

Also, compared to FIG. 3 and FIG. 4, in FIG. 4 where the first plane 300-1 and the second plane 300-2 are not parallel, as a distance between one side end of the inner tube 100 to which a first refrigerant flows into and the other side end to which a first refrigerant flows out becomes closer in space, it is apparent that a degree of freedom and efficiency in a design such as arrangement of a device to be connected to both ends of the inner tube 100 may be improved.

In an embodiment of the disclosure, an angle formed between the first plane 300-1 and the second plane 300-2 may be between 50° and 70°. Referring to FIG. 4, for example, optimal space efficiency may be achieved when the first outer tube 200-1, the second outer tube 200-2, and the third outer tube 200-3, each having a same diameter, are gathered, and an angle formed between the first plane 300-1 and the second plane 300-2 is 60°.

In this regard, as the first outer tube 200-1 and the third outer tube 200-3 positioned at the bottom are gathered and the second outer tube 200-2 positioned at the top is farther away from them, an angle formed between the first plane 300-1 and the second plane 300-2 becomes small but space efficiency deteriorates and, simultaneously, a ratio of the bending portions 110 where exchange of heat does not occur is increased at the inner tube 100.

Equally, as the position of the second outer tube 200-2 at the top is fixed and the distance between the first outer tube 200-1 and the third outer tube 200-3 at the bottom increases, an angle formed between the first plane 300-1 and the second plane 300-2 becomes large but space efficiency deteriorates and, simultaneously, a ratio of the bending portions 110 where exchange of heat occurs is increased at the inner tube 100.

Therefore, in consideration of a distance between two outer tubes 200, the distance being implementable in the manufacture, in the heat exchanger according to an embodiment of the disclosure, an angle formed between the first plane 300-1 and the second plane 300-2 may be arranged to be between 50° and 70°.

Referring to FIG. 5, the heat exchanger according to an embodiment of the disclosure may include at least three bending portions 110 of the inner tube 100, at least four outer tubes 200, in which the first plane 300-1 on which one of the outer tubes 200 and another one of the outer tubes 200 that is directly connected to one side of the one outer tube 200 via the connection tube 220 are positioned may be arranged not to be parallel to the second plane 300-2 on which the one outer tube 200 and the different one outer tube 200 that is directly connected to the other side of the one outer tube 200 via the connection tube 220 are positioned.

In an embodiment of the disclosure, an angle formed between the first plane 300-1 and the second plane 300-2 may be different from an angle formed between the second plane 300-2 and a third plane 300-3.

For example, the first plane 300-1 on which the second outer tube 200-2 and the first outer tube 200-1 directly connected to the second outer tube 200-2 by the first connection tube 220-1 are positioned may not be parallel to the second plane 300-2 on which the second outer tube 200-2 and the third outer tube 200-3 directly connected to the second outer tube 200-2 by the second connection tube 220-2 are positioned, the second plane 300-2 on which the third outer tube 200-3 and the second outer tube 200-2 directly connected to the third outer tube 200-3 by the second connection tube 220-2 are positioned may not be parallel to the third plane 300-3 on which the third outer tube 200-3 and the fourth outer tube 200-4 directly connected to the third outer tube 200-3 by the third connection tube 220-3 are positioned, and the angle formed by the first plane 300-1 and the second plane 300-2 may be different from the angle formed by the second plane 300-2 and the third plane 300-3.

In this case, as it is possible to implement various stage structures, it is apparent that space diversity and efficiency are further improved, compared to embodiments of FIGS. 3 and 4.

Figure 6:
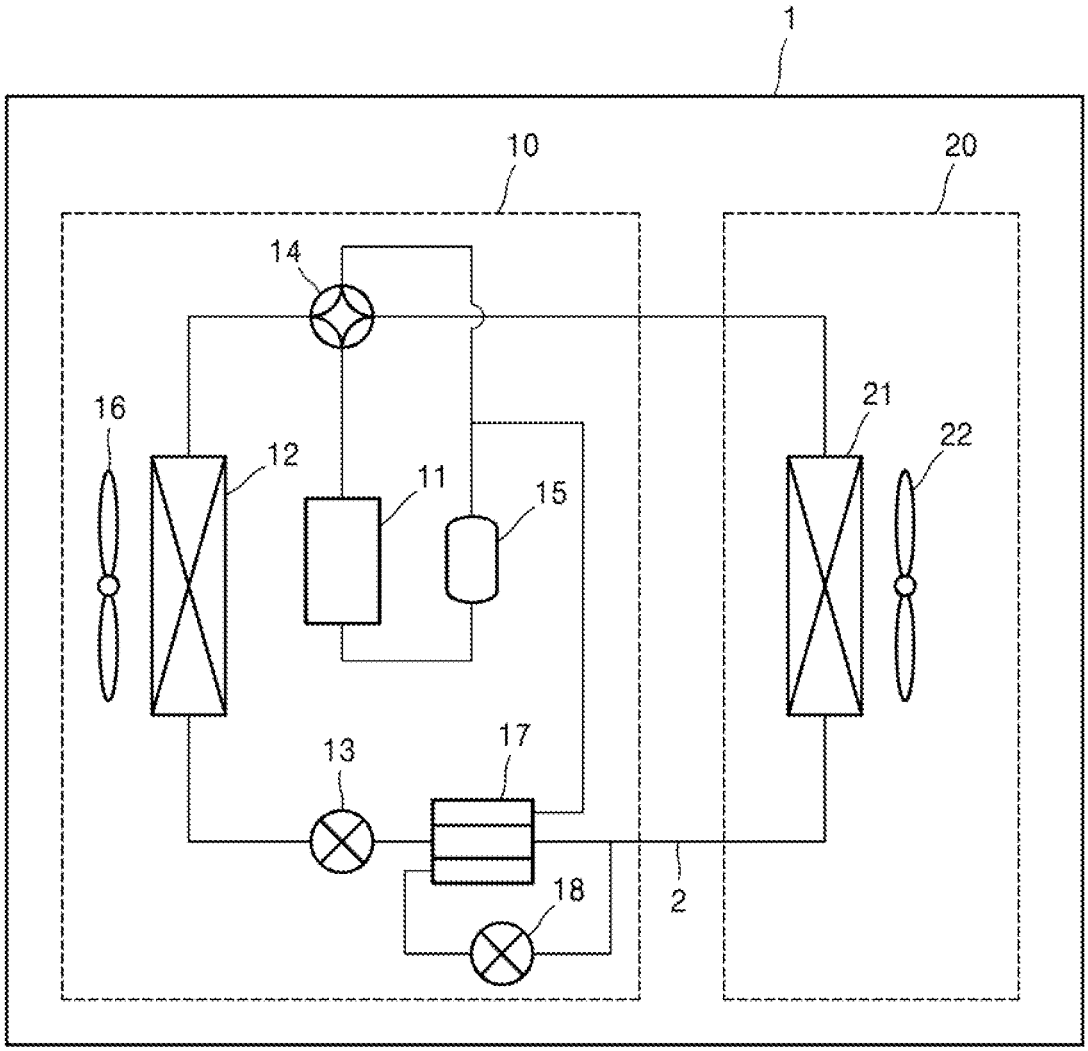
FIG. 6 illustrates a schematic diagram of an air conditioner according to an embodiment of the disclosure.

FIG. 6 illustrates a schematic diagram of an air conditioner according to an embodiment of the disclosure.

With reference to FIG. 6, an air conditioner 1 according to an embodiment of the disclosure will now be described in detail. In descriptions, same elements as the heat exchanger are referenced with same reference numerals, and redundant descriptions thereof are omitted or described with reference to differences therebetween. It may be interpreted that elements being referenced with same reference numerals have the same structure, function, and effect, and the same modification may be available even in modified examples.

For cooling of an air conditioning space to be air conditioned, the air conditioner 1 according to various embodiments of the disclosure may absorb heat from the air conditioning space (hereinafter, referred to as "the inside") and may emit heat to the outside of the air conditioning space (hereinafter, referred to as "the outside"). Also, for heating of the inside, the air conditioner 1 may absorb heat from the outside and may emit heat to the inside.

The air conditioner 1 may include at least one outdoor unit 10 installed at the outside and at least one indoor unit 20 installed at the inside. The outdoor unit 10 may be electrically connected to the indoor unit 20. For example, a user may input information (or a command) to control the indoor unit 20 via a user interface, and the outdoor unit 10 may operate in response to the user input to the indoor unit 20.

The outdoor unit 10 is provided in the outside. The outdoor unit 10 may perform exchange of heat between a refrigerant and outdoor air by using a phase change (e.g., evaporation or condensation) of the refrigerant. For example, while the refrigerant is condensed in the outdoor unit 10, the refrigerant may emit heat to the outdoor air. While the refrigerant evaporates in the outdoor unit 10, the refrigerant may absorb heat from the outdoor air.

The indoor unit 20 is provided in the inside. The indoor unit 20 may be provided in various forms in the inside. For example, the indoor unit 20 may be provided as a stand indoor unit, a wall-mounted indoor unit, or a ceiling-mounted indoor unit. The indoor unit 20 may perform exchange of heat between a refrigerant and indoor air by using a phase change (e.g., evaporation or condensation) of the refrigerant. For example, while the refrigerant evaporates in the indoor unit 20, the refrigerant may absorb heat from the indoor air, and the inside may be cooled. While the refrigerant is condensed in the indoor unit 20, the refrigerant may emit heat to the indoor air, and the inside may be cooled.

Referring to FIG. 6, the air conditioner 1 may include a compressor 11, an outdoor heat exchanger 12, an expansion device 13, an indoor heat exchanger 21, and a refrigerant tube 2. The refrigerant tube 2 may connect the compressor 11, the outdoor heat exchanger 12, the expansion device 13, and the indoor heat exchanger 21.

The outdoor unit 10 may be fluidly connected to the indoor unit 20 via the refrigerant tube 2. A refrigerant may circle between the outdoor unit 10 and the indoor unit 20 via the refrigerant tube 2. The refrigerant may circle in order of the compressor 11, the outdoor heat exchanger 12, the expansion device 13, and the indoor heat exchanger 21 via refrigerant tube 2, or may circle in order of the compressor 11, the indoor heat exchanger 21, the expansion device 13, and the outdoor heat exchanger 12.

The compressor 11, the outdoor heat exchanger 12, the expansion device 13 may be arranged in the outdoor unit 10. The indoor heat exchanger 21 may be installed in the indoor unit 20. However, configurations of the outdoor unit 10 and the indoor unit 20 are not limited thereto and may vary. For example, a position of the expansion device 13 is not limited to the outdoor unit 10, and may be provided in the indoor unit 20 when required.

The compressor 11 may compress a refrigerant gas. The refrigerant gas may be converted from a low-temperature and low-pressure state to a high-temperature and high-pressure while being compressed by the compressor 11.

The air conditioner 1 may further include a flow-path switching valve 14. The flow-path switching valve 14 may include, for example, a 4-way valve. The flow-path switching valve 14 may switch a circling path of a refrigerant, according to an operation mode (e.g., a cooling operation or a heating operation) of the air conditioner 1. The flow-path switching valve 14 may be connected to an outlet of the compressor 11 from which the refrigerant gas is discharged.

The air conditioner 1 may include an accumulator 15. The accumulator 15 may be connected to an inlet of the compressor 11 to which a refrigerant gas flows. A low-temperature and low-pressure refrigerant evaporated from the indoor heat exchanger 21 or the outdoor heat exchanger 12 may flow into the accumulator 15. When a refrigerant that is a mixture of a refrigerant liquid and a refrigerant gas flows into the accumulator 15, the accumulator 15 may separate the refrigerant liquid from the refrigerant gas and may provide the refrigerant gas excluding the refrigerant liquid to the compressor 11.

Exchange of heat between the refrigerant and outdoor air may be performed in the outdoor heat exchanger 12. For example, during a cooling operation, a high-pressure and high-temperature refrigerant may be condensed in the outdoor heat exchanger 12, and the refrigerant may emit heat to the outdoor air while the refrigerant is condensed. During a heating operation, a low-temperature and low-pressure refrigerant may be evaporated in the outdoor heat exchanger 12, and the refrigerant may absorb heat from the outdoor air while the refrigerant evaporates.

An outdoor fan 16 may be provided adjacent to the outdoor heat exchanger 12. The outdoor fan 16 may send outdoor air to the outdoor heat exchanger 12 so as to promote exchange of heat between the refrigerant and the outdoor air.

The expansion device 13 may decrease a pressure and temperature of the refrigerant condensed in the outdoor heat exchanger 12 during the cooling operation, and may decrease a pressure and temperature of the refrigerant condensed in the indoor heat exchanger 21 during the heating operation.

The expansion device 13 may decrease a temperature and pressure of a refrigerant by using, for example, a throttle effect. The expansion device 13 may include an orifice for decreasing a cross-sectional area of a flow path. A temperature and pressure of the refrigerant having passed through the orifice may be decreased.

The expansion device 13 may be implemented as an electronic expansion device capable of adjusting an opening ratio (a ratio of a cross-sectional area of a flow path of a valve in a fully-open state to a cross-sectional area of the flow path of the valve in a partially-open state). According to the opening ratio of the electronic expansion device, an amount of a refrigerant passing through the expansion device 13 may be controlled.

The air conditioner 1 may include a subcooler 17. When a length of a tube between the outdoor heat exchanger 12 and the indoor heat exchanger 21 is large, the subcooler 17 may be provided to maintain a refrigerant in a liquid state. The subcooler 17 may be provided as a heat exchanger that performs exchange of heat between a first refrigerant flowing in the refrigerant tube 2 and a second refrigerant flowing in an outer tube, wherein the refrigerant tube 2 connecting the outdoor heat exchanger 12 to the indoor heat exchanger 21 serves as an inner tube and the outer tube surrounds the inner tube in the subcooler 17.

During a cooling operation, a part of the first refrigerant cooled after passing through the subcooler 17 flows into a branch of the refrigerant tube 2 and thus may flow back into the subcooler 17.

The refrigerant flowing back into the subcooler 17 may be expanded and cooled by an expansion device 18 provided on a branched path, may flow into the outer tube of the subcooler 17, and thus, may supercool the first refrigerant flowing the refrigerant tube 2, by exchange of heat.

The refrigerant of which first refrigerant is supercooled by flowing back into the subcooler 17 may be provided to the accumulator 15.

Exchange of heat between a refrigerant and indoor air may be performed in the indoor heat exchanger 21. During a cooling operation, a low-temperature and low-pressure refrigerant evaporates in the indoor heat exchanger 21, and the refrigerant may absorb heat from indoor air while the refrigerant evaporates. During a heating operation, a high-temperature and high-pressure refrigerant is condensed in the indoor heat exchanger 21, and the refrigerant may emit heat to indoor air while the refrigerant is condensed.

An indoor fan 22 may be provided adjacent to the indoor heat exchanger 21. The indoor fan 22 may send indoor air to the indoor heat exchanger 21 so as to promote exchange of heat between the refrigerant and the indoor air. A form of the indoor fan 22 may vary. For example, the indoor fan 22 may include at least one of an axial-flow fan, a supercritical-flow fan, a cross-flow fan, or a centrifugal fan.

In the air conditioner 1 according to an embodiment of the disclosure, at least one of the indoor heat exchanger 21, the outdoor heat exchanger 12, or the subcooler 17 may include the heat exchanger according to embodiments described above.

For example, referring back to FIGS. 1 and 2, in the air conditioner 1 according to an embodiment of the disclosure, at least one of the indoor heat exchanger 21, the outdoor heat exchanger 12, or the subcooler 17 may include the inner tube 100 and the outer tube 200. The inner tube 100 may be provided as a tube forming a single continuous flow path, and the outer tube 200 may be provided as a plurality of independent tubes which are indirectly connected with each other via a connection tube 220.

In an embodiment of the disclosure, a first refrigerant may flow in the inner tube 100. For example, a first refrigerant is flowable through the first heat exchange portion 120-1, then the bending portion 110, and then the second heat exchange portion 120-2.

In an embodiment of the disclosure, the first refrigerant may have a temperature different from that of a second refrigerant, and may increase or decrease a temperature of the second refrigerant by exchanging heat with the second refrigerant.

For example, at least one of the indoor heat exchanger 21, the outdoor heat exchanger 12, and the subcooler 17 included in the air conditioner 1 according to an embodiment of the disclosure may be provided with the first refrigerant having a lower temperature and the second refrigerant having a higher temperature than the first refrigerant, such that as heat exchange is performed, the first refrigerant cools the second refrigerant to increase the subcooling of the second refrigerant.

In an embodiment of the disclosure, the inner tube 100 may include a bending portion 110 that is a portion of the inner tube 100 which is bent with a preset curvature at at least one point, and heat exchange portions 120 that respectively extend from both ends of the bending portion 110. For example, in an embodiment of the disclosure, the bending portion 110 bent with a preset curvature may include a first end and a second end, and may extend the first heat exchange portion 120-1 from the first end of the bending portion 110 and the second heat exchange portion 120-2 from the second end of the bending portion 110.

In an embodiment of the disclosure, the inner tube 100 may have a diameter between 6 mm and 10 mm.

In an embodiment of the disclosure, the bending portion 110 may be understood as a portion of an inner tube 100 that is bent or deformed so as to allow an inner tube 100 forming a continuous flow path to be inserted into a plurality of outer tubes 200 that are not positioned in a straight line.

For example, the bending portion 110 of the inner tube 100 may be bent in the form of a semicircle to be inserted into the first outer tube 200-1 and the second outer tube 200-2 that are provided in parallel, wherein a remote distance between the first outer tube 200-1 and the second outer tube 200-2 corresponds to a diameter of the semicircle.

In an embodiment of the disclosure, the bending portion 110 may be bent such that a curvature radius thereof is between 10 mm and 30 mm.

In an embodiment of the disclosure, the bending portion 110 may include a flexible material, and may have an insulation member (not shown) for surrounding the bending portion 110. For example, the insulation member may include an organic insulator such as expanded-polystyrene, expanded-polyurethane, expanded-vinyl chloride, etc.

In an embodiment of the disclosure, the heat exchange portions 120 may be provided while extending from both ends of the bending portion 110. For example, the heat exchange portions 120 may include the first heat exchange portion 120-1 that is formed with the inner tube 100 extending form the first end of the bending portion 110 and performs heat exchange with the inner the first outer tube 200-1, and the second heat exchange portion 120-2 that is formed with the inner tube 100 extending from the second end of the bending portion 110 and performs heat exchange with the second outer tube 200-2.

In the air conditioner 1 according to an embodiment of the disclosure, in at least one of the indoor heat exchanger 21, the outdoor heat exchanger 12, or the subcooler 17, the outer tube 200 may be provided at each of the heat exchange portions 120 of the inner tube 100. For example, in the inner tube 100 forming a single continuous flow path, the outer tubes 200 may be independently provided in such a manner that the outer tubes 200 are not positioned on the bending portion 110 and are positioned only on the heat exchange portions 120 that extend from both ends of the bending portion 110.

In an embodiment of the disclosure, the outer tubes 200 may include therein the heat exchange portions 120 of the inner tube 100, such that a double-tube structure between the inner tube 100 and the outer tubes 200 may be formed. Due to the double-tube structure, a second refrigerant may flow between the outer tube 200 and the heat exchange portion 120 of the inner tube 100, and may exchange heat with a first refrigerant at an outer circumferential surface of the heat exchange portion 120 as a boundary.

For example, the first outer tube 200-1 may include the first heat exchange portion 120-1 of the inner tube 100 inside to form a double-tube structure with the inner tube 100, and the first refrigerant flowing inside the first heat exchange portion 120-1 of the inner tube 100 and the second refrigerant flowing inside the first outer tube 200-1 may exchange heat with the outer circumferential surface of the first heat exchange portion 120-1 as the first boundary.

Equally, the second outer tube 200-2 may include the second heat exchange portion 120-2 of the inner tube 100 inside to form a double-tube structure with the inner tube 100, and the first refrigerant flowing inside the second heat exchange portion 120-2 of the inner tube 100 and the second refrigerant flowing inside the second outer tube 200-2 may exchange heat with the outer circumferential surface of the second heat exchange portion 120-2 as the second boundary.

In an embodiment of the disclosure, the outer tube 200 may be provided to have a diameter between 12 mm to 20 mm.

For example, each of the first outer tube 200-1, the second outer tube 200-2, and the third outer tube 200-3 may have a diameter of 12 mm to 20 mm.

In an embodiment of the disclosure, the outer tubes 200 that are connected to each other via the connection tube 220 may be spaced apart from each other by 20 mm to 60 mm.

For example, the first outer tube 200-1 and the second outer tube 200-2 connected to each other via the first connection tube 220-1 may be spaced apart by 20 mm to 60 mm, and the second outer tube 200-2 and the third outer tube 200-3 connected to each other via the second connection tube 220-2 may be spaced apart by 20 mm to 60 mm.

In the air conditioner 1 according to an embodiment of the disclosure, a through hole 210 may be understood as a path through which the second refrigerant flows into or is discharged from the outer tube 200.

In an embodiment of the disclosure, the through hole 210 may be provided at each of outer circumferential surfaces of both ends of one outer tube 200. Sizes of the through holes 210 provided at one outer tube 200 may be equal to or different from each other, and an angle between the through holes 210 which is formed with respect to an axis of one outer tube 200 may vary according to designs.

For example, referring to FIG. 3, the second through hole 210-2 and the third through hole 210-3 on the second tube 200-2 may form a 180 degree angle with respect to an axis of the second outer tube 200-2.

For example, referring to FIG. 4, the second through hole 210-2 and the third through hole 210-3 of the second outer tube 200-2 may form an angle less than 180 degrees with respect to an axis of the second outer tube 200-2.

In the air conditioner 1 according to an embodiment of the disclosure, the connection tube 220 included in at least one of the indoor heat exchanger 21, the outdoor heat exchanger 12, or the subcooler 17 may be understood as a tube that connects the outer tubes 200 positioned at both ends of the bending portion 110 so as to allow a second refrigerant to flow between the outer tubes 200.

According to an embodiment of the disclosure, the connection tube 220 may be provided to have a cylindrical form to connect the outer tubes 200 by a shortest distance. However, the disclosure is not limited thereto, and the connection tube 220 may have a curved surface or a curvature or may be bent with a particular angle, according to designs.

In an embodiment of the disclosure, a cross-sectional area of the connection tube 220 may be equal to an area between the heat exchange portion 120 and the outer tube 200. This is to allow a flow speed of a second refrigerant flowing in the outer tube 200 not to change in the connection tube 220. However, the disclosure is not limited thereto.

In an embodiment of the disclosure, the connection tube 220 may include a material having a preset rigidity. In designing at least one of the indoor heat exchanger 21, the outdoor heat exchanger 12, and the subcooler 17, the preset rigidity may be understood as a rigidity enough to maintain the gap between the outer tubes 200.

In the air conditioner 1 according to an embodiment of the disclosure, in at least one of the indoor heat exchanger 21, the outdoor heat exchanger 12, or the subcooler 17, n bending portions 110 may be provided at the inner tube 100, and n+1 outer tubes 200 may be provided. Here, n is a natural number equal to or greater than 2.

In the air conditioner 1 according to an embodiment of the disclosure, in at least one of the indoor heat exchanger 21, the outdoor heat exchanger 12, or the subcooler 17, all outer tubes 200 may be arranged to be positioned on a same plane.

For example, referring to FIG. 3, the first outer tube 200-1, the second outer tube 200-2, and the third outer tube 200-3 may all be positioned on a same plane.

In the air conditioner 1 according to an embodiment of the disclosure, in at least one of the indoor heat exchanger 21, the outdoor heat exchanger 12, or the subcooler 17, the first plane 300-1 on which one of the outer tubes 200 and another one of the outer tubes 200 that is directly connected to one side of the one outer tube 200 via the connection tube 220 are positioned may be arranged not to be parallel to the second plane 300-2 on which the one outer tube 200 and the different one outer tube that is directly connected to the other side of the one outer tube 200 via the connection tube 220 are positioned.

For example, referring to FIG. 4, a first plane 300-1 on which the second outer tube 200-2 and the first outer tube 200-1 that is directly connected to the second outer tube 200-2 via the first connection tube 220-1 are positioned may not be parallel to the second plane 300-2 on which the second outer tube 200-2 and the third outer tube 200-3 that is directly connected to the second outer tube 200-2 via the second connection tube 220-2 are positioned.

In at least of the indoor heat exchanger 21, the outdoor heat exchanger 12, and the subcooler 17, based on a three-stage separation structure comprising three outer tubes 200 and an inner tubes 100 with two bending portions 110, it is readily apparent that the same effective heat transfer length may be realized within a more compact space when the first plane 300-1 and the second plane 300-2 are not parallel.

Also, compared to FIG. 3 and FIG. 4, in FIG. 4 where the first plane 300-1 and the second plane 300-2 are not parallel, as a distance between one side end of the inner tube 100 to which a first refrigerant flows into and the other side end to which a first refrigerant flows out becomes closer in space, it is apparent that a degree of freedom and efficiency in a design such as arrangement of a device to be connected to both ends of the inner tube 100 may be improved.

In an embodiment of the disclosure, an angle formed between the first plane 300-1 and the second plane 300-2 may be between 50° and 70°.

Referring back to FIG. 5, in the air conditioner 1 according to an embodiment of the disclosure, at least one of the indoor heat exchanger 21, the outdoor heat exchanger 12, or the subcooler 17 may include at least three bending portions 110 of the inner tube 100, at least four outer tubes 200, in which the first plane 300-1 on which one of the outer tubes 200 and another one of the outer tubes 200 that is directly connected to one side of the one outer tube 200 via the connection tube 220 are positioned may be arranged not to be parallel to the second plane 300-2 on which the one outer tube 200 and the different one outer tube 200 that is directly connected to the other side of the one outer tube 200 via the connection tube 220 are positioned.

In an embodiment of the disclosure, an angle formed between the first plane 300-1 and the second plane 300-2 may be different from an angle formed between the second plane 300-2 and a third plane 300-3.

For example, the first plane 300-1 on which the second outer tube 200-2 and the first outer tube 200-1 directly connected to the second outer tube 200-2 by the first connection tube 220-1 are positioned may not be parallel to the second plane 300-2 on which the second outer tube 200-2 and the third outer tube 200-3 directly connected to the second outer tube 200-2 by the second connection tube 220-2 are positioned, the second plane 300-2 on which the third outer tube 200-3 and the second outer tube 200-2 directly connected to the third outer tube 200-3 by the second connection tube 220-2 are positioned may not be parallel to the third plane 300-3 on which the third outer tube 200-3 and the fourth outer tube 200-4 directly connected to the third outer tube 200-3 by the third connection tube 220-3 are positioned, and the angle formed by the first plane 300-1 and the second plane 300-2 may be different from the angle formed by the second plane 300-2 and the third plane 300-3.

For understanding of the disclosure, reference numerals are written in embodiments shown in the drawings and specific terms are used to describe the embodiments of the disclosure, but the disclosure is not limited by the specific terms and the disclosure may include all elements commonly conceivable by one of ordinary skill in the art.

The particular implementations shown and described in the disclosure are embodiments of the disclosure and are not intended to otherwise limit the scope of the disclosure in any way. For the sake of brevity of the present specification, electronics according to the related art, control systems, software and other functional aspects of the systems may not be described in detail. Furthermore, the connecting lines or connectors between elements shown in the drawings are intended to represent exemplary functional relationships and/or physical or logical couplings between the elements, and it should be noted that many alternative or additional functional relationships, physical connections or logical connections may be present in a practical device. Also, no element is essential to the practice of the disclosure unless the element is specifically described as "essential" or "critical". Expressions such as "comprising" and "including" used herein are to be understood as terms of an open end technology.

The use of the terms "a" and "an" and "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range (unless otherwise indicated herein), and each separate value is incorporated into the specification as if it were individually recited herein. Finally, the steps of all methods described in the disclosure can be performed in any suitable order unless otherwise indicated herein or otherwise clearly contradicted by context. The disclosure is not limited by the steps described herein. The use of any and all examples, or exemplary language (e.g., "such as") provided herein, is intended merely to better illuminate the disclosure and does not pose a limitation on the scope of the disclosure unless otherwise claimed. Also, numerous modifications and adaptations will be readily apparent to one of ordinary skill in the art, without departing from the spirit and scope of the disclosure.

According to an embodiment of the disclosure, a heat exchanger includes an inner tube including a bending portion bent with a preset curvature, and having a first end and a second end, a first heat exchange portion extending from the first end of the bending portion, and a second heat exchange portion extending from the second end of the bending portion; a first outer tube through which the first heat exchange portion extends so as to form a first double-tube structure with a first boundary at an outer circumferential surface of the first heat exchange portion, the first outer tube including a first through hole at an outer circumferential surface of the first outer tube; a second outer tube through which the second heat exchange portion extends so as to form a second double-tube structure with a second boundary at an outer circumferential surface of the second heat exchange portion, the second outer tube including a second through hole at an outer circumferential surface of the second outer tube; and a first connection tube connecting the first through hole of the first outer tube and the second through hole of the second outer tube so as to connect the first outer tube and the second outer tube, The heat exchanger is configured so that a first refrigerant is flowable through the first heat exchange portion, then the bending portion, and then the second heat exchange portion, a second refrigerant is flowable through the first outer tube, then through the first connection tube, and then second outer tube, and the second refrigerant exchanges heat with the first refrigerant at the first boundary inside the first outer tube, and at the second boundary inside the second outer tube.

According to an embodiment of the disclosure, the first outer tube and the second outer tube are in parallel on a same plane.

According to an embodiment of the disclosure, the heat exchanger may include n+1 outer tubes, the inner tube may includes n bending portions, and n may be a natural number equal to or greater than 2.

According to an embodiment of the disclosure, the second outer tube includes a third through hole at the outer circumferential surface of the second outer tube, The heat exchanger may include a second connection tube, and a third outer tube including a fourth through hole at an outer circumferential surface of the third outer tube, The second connection tube connects the third through hole of the second outer tube and the fourth through hole of the third outer tube so as to connect the second outer tube and the third outer tube, The first outer tube and the second outer tube are in parallel in a first plane, The second outer tube and the third outer tube are in parallel in a second plane, and The first plane and the second plane are not parallel.

According to an embodiment of the disclosure, an angle between the first plane and the second plane may be between 50° and 70°.

According to an embodiment of the disclosure, the first outer tube and the second outer may be spaced apart from each other by 20 mm to 60 mm.

According to an embodiment of the disclosure, the heat exchanger may further include an insulation member surrounding the bending portion, the insulation member including a flexible material.

According to an embodiment of the disclosure, the bending portion is bent such that a curvature radius of the bending portion is between 10 mm and 30 mm.

According to an embodiment of the disclosure, the inner tube may have a diameter between 6 mm and 10 mm, Each of the first outer tube and the second outer tube may have a diameter between 12 mm to 20 mm.

According to an embodiment of the disclosure, an air conditioner includes a compressor; an indoor heat exchanger; an outdoor heat exchanger; a subcooler; and an expansion valve. At least one of the indoor heat exchanger, the outdoor heat exchanger, and the subcooler includes an inner tube including a bending portion bent with a preset curvature, and having a first end and a second end, a first heat exchange portion extending from the first end of the bending portion, and a second heat exchange portion extending from the second end of the bending portion; a first outer tube through which the first heat exchange portion extends so as to form a first double-tube structure with a first boundary at an outer circumferential surface of the first heat exchange portion, the first outer tube including a first through hole at an outer circumferential surface of the first outer tube; a second outer tube through which the second heat exchange portion extends so as to form a second double-tube structure with a second boundary at an outer circumferential surface of the second heat exchange portion, the second outer tube including a second through hole at an outer circumferential surface of the second outer tube; and a first connection tube connecting the first through hole of the first outer tube and the second through hole of the second outer tube so as to connect the first outer tube and the second outer tube. The at least one of the indoor heat exchanger, the outdoor heat exchanger, and the subcooler is configured so that a first refrigerant is flowable through the first heat exchange portion, then the bending portion, and then the second heat exchange portion, a second refrigerant is flowable through the first outer tube, then through the first connection tube, and then second outer tube, and the second refrigerant exchanges heat with the first refrigerant at the first boundary inside the first outer tube, and at the second boundary inside the second outer tube.

According to an embodiment of the disclosure, the first outer tube and the second outer tube may be in parallel on a same plane.

According to an embodiment of the disclosure, the at least one of the indoor heat exchanger, the outdoor heat exchanger, and the subcooler may includes n+1 outer tubes, the inner tube may include n bending portions, and n may be a natural number equal to or greater than 2.

According to an embodiment of the disclosure, the second outer tube may include a third through hole at the outer circumferential surface of the second outer tube. The at least one of the indoor heat exchanger, the outdoor heat exchanger, and the subcooler may include a second connection tube, and a third outer tube including a fourth through hole at an outer circumferential surface of the third outer tube. The second connection tube may connect the third through hole of the second outer tube and the fourth through hole of the third outer tube so as to connect the second outer tube and the third outer tube. The first outer tube and the second outer tube may be in parallel in a first plane. The second outer tube and the third outer tube may be in parallel in a second plane. The first plane and the second plane may not be parallel.

According to an embodiment of the disclosure, an angle between the first plane and the second plane may be between 50° and 70°.

According to an embodiment of the disclosure, the first outer tube and the second outer tube may be spaced apart from each other by 20 mm to 60 mm.

The invention claimed is:

1. A heat exchanger comprising:

an inner tube including:

a plurality of bending portions bent with a preset curvature, each bending portion of the plurality of bending portions having a first end and a second end, a plurality of first heat exchange portions extending respectively from the first end of each bending portion of the plurality of bending portions, and a plurality of second heat exchange portions extending respectively from the second end of each bending portion of the plurality of bending portions;

a plurality of outer tubes each having the first heat exchange portion or the second heat exchange portion extending from one bending portion of the plurality of bending portion extending therethrough so as to form a first double-tube structure with a-first boundary at an outer circumferential surface of the first heat exchange portion or the second heat exchange portion extending through the respective outer tube, each outer tube of the plurality of outer tubes including at least one through hole at an outer circumferential surface thereof;

a plurality of connection tubes respectively connecting facing pairs of through holes of the at least one through hole included in a pair of outer tubes of the plurality of outer tubes that surround the first heat exchange portion and the second heat exchange portion of a same bending portion of the plurality of bending portions, wherein the heat exchanger is configured so that:

a first connection tube connects a first outer tube of the plurality of outer tubes to a second outer tube of the plurality of outer tubes, a second connection tube connects the second outer tube to a third outer tube of the plurality of outer tubes, a third connection tube connects the third outer tube to a fourth outer tube of the plurality of outer tubes, a first plane on which the first outer tube and the second outer tube are positioned in parallel is not parallel to a second plane on which the second outer tube and the third outer tube are positioned in parallel, the second plane is not parallel with a third plane on which the third outer tube and the fourth outer tube are positioned in parallel, an angle formed by the first plane and the second plane is different from an angle formed by the second plane and the third plane, a first refrigerant is flowable respectively through the first heat exchange portions, then the bending portions, and then the second heat exchange portions of the inner tube, a second refrigerant is flowable through the first outer tube, then through the first connection tube, then through the second outer tube, then through the second connection tube, then through the third outer tube, then through the third connection tube, and then through the fourth outer tube, and the second refrigerant exchanges heat with the first refrigerant at the first boundary inside the respective outer tubes of the plurality of outer tubes.

2. The heat exchanger of claim 1, wherein the heat exchanger comprises n+1 outer tubes, the inner tube includes n bending portions, and n is a natural number equal to or greater than 3.

3. The heat exchanger of claim 1, wherein an angle between the first plane and the second plane is between 50° and 70°.

4. The heat exchanger of claim 1, wherein the first outer tube and the second outer tube are spaced apart from each other by 20 mm to 60 mm.

5. The heat exchanger of claim 1, further comprising:

a plurality of insulation members respectively surrounding each bending portion of the plurality of bending portions, the insulation members including a flexible material.

6. The heat exchanger of claim 1, wherein each bending portion of the plurality of bending portions is bent such that a curvature radius of the bending portion is between 10 mm and 30 mm.

7. The heat exchanger of claim 1, wherein the inner tube has a diameter between 6 mm and 10 mm, and each of the first outer tube and the second outer tube has a diameter between 12 mm to 20 mm.

8. An air conditioner comprising:

a compressor;

an indoor heat exchanger;

an outdoor heat exchanger;

a subcooler; and an expansion valve, wherein at least one of the indoor heat exchanger, the outdoor heat exchanger, and the subcooler includes:

an inner tube including:

a plurality of bending portions bent with a preset curvature, each bending portion of the plurality of bending portions having a first end and a second end, a plurality of first heat exchange portions extending respectively from the first end of each bending portion of the plurality of bending portions, and a plurality of second heat exchange portions extending respectively from the second end of each bending portion of the plurality of bending portions;

a plurality of outer tubes each having the first heat exchange portion or the second heat exchange portion extending from one bending portion of the plurality of bending portion extending therethrough so as to form a first double-tube structure with boundary at an outer circumferential surface of the first heat exchange portion or the second heat exchange portion extending through the respective outer tube, each outer tube of the plurality of outer tubes including at least one through hole at an outer circumferential surface thereof;

a plurality of connection tubes respectively connecting facing pairs of through holes of the at least one through hole included in a pair of outer tubes of the plurality of outer tubes that surround the first heat exchange portion and the second heat exchange portion of a same bending portion of the plurality of bending portions, wherein the at least one of the indoor heat exchanger, the outdoor heat exchanger, and the subcooler is configured so that:

a first connection tube connects a first outer tube of the plurality of outer tubes to a second outer tube of the plurality of outer tubes, a second connection tube connects the second outer tube to a third outer tube of the plurality of outer tubes, a third connection tube connects the third outer tube to a fourth outer tube of the plurality of outer tubes, a first plane on which the first outer tube and the second outer tube are positioned in parallel is not parallel to a second plane on which the second outer tube and the third outer tube are positioned in parallel, the second plane is not parallel with a third plane on which the third outer tube and the fourth outer tube are positioned in parallel, an angle formed by the first plane and the second plane is different from an angle formed by the second plane and the third plane, a first refrigerant is flowable respectively through the first heat exchange portions, then the bending portions, and then the second heat exchange portions of the inner tube, a second refrigerant is flowable through the first outer tube, then through the first connection tube, then through the second outer tube, then through the second connection tube, then through the third outer tube, then through the third connection tube, and then through the fourth outer tube, and the second refrigerant exchanges heat with the first refrigerant at the first boundary inside the respective outer tubes of the plurality of outer tubes.

9. The air conditioner of claim 8, wherein the at least one of the indoor heat exchanger, the outdoor heat exchanger, and the subcooler includes n+1 outer tubes, the inner tube includes n bending portions, and n is a natural number equal to or greater than 3.

10. The air conditioner of claim 8, wherein an angle between the first plane and the second plane is between 50° and 70°.

11. The air conditioner of claim 8, wherein the first outer tube and the second outer tube are spaced apart from each other by 20 mm to 60 mm.

* * * * *